US008434176B1

(12) United States Patent
Harrison

(10) Patent No.: US 8,434,176 B1
(45) Date of Patent: May 7, 2013

(54) BACK SUPPORT PILLOW SYSTEM

(76) Inventor: Raymond M. Harrison, Douglasville, GA (US)

( * ) Notice: Subject to any disclaimer, the term of this patent is extended or adjusted under 35 U.S.C. 154(b) by 0 days.

(21) Appl. No.: 13/562,575

(22) Filed: Jul. 31, 2012

(51) Int. Cl.
*A47C 20/00* (2006.01)

(52) U.S. Cl.
USPC ..... 5/632; 5/630; 5/655.9

(58) Field of Classification Search ..... 5/630, 632, 5/648, 636, 655.9, 657
See application file for complete search history.

(56) References Cited

U.S. PATENT DOCUMENTS 4,901,384 A 2/1990 Eary
4,987,625 A 1/1991 Edelson
5,016,303 A 5/1991 Tanaka et al.
5,048,137 A 9/1991 Rogers
5,163,195 A * 11/1992 Hill ..... 5/637
D356,919 S 4/1995 Nadeau
5,423,098 A 6/1995 Swezey et al.
5,742,963 A * 4/1998 Trevino et al. ..... 5/632
D396,757 S 8/1998 Katz et al.
5,797,153 A * 8/1998 Amioka ..... 5/632
5,987,675 A 11/1999 Kim
6,823,545 B1 11/2004 Davis
7,661,163 B1 2/2010 Gallaher

* cited by examiner

*Primary Examiner* — Fredrick Conley

(57) ABSTRACT

A pillow kit for providing comfort to user featuring a back support pillow system for positioning a user's back in a comfortable position, a C-shaped neck pillow adapted to wrap around a user's neck; and a cylindrical knee pillow adapted to be placed under a user's knees. The back support pillow system features a base pillow with a head indentation, two opposing wings for supporting the user's arms, and a removable lumbar support bar.

6 Claims, 5 Drawing Sheets

(ISO View)

(Detail View)

(Side View)

(In-use View)

(In-use View)

BACK SUPPORT PILLOW SYSTEM

BACKGROUND OF THE INVENTION

Many individuals experience discomfort, e.g., lumbar discomfort, when sleeping or resting. The present invention features a back support and positioning pillow system. The system of the present invention can help provide support to the user's upper and lower back (e.g., cervical and lumbar spine areas), which may provide comfort to those areas. The system may help a user sleep better.

SUMMARY

The present invention features a pillow kit. The kit may include various pillows for providing comfort to user. For example, in some embodiments, the pillow kit comprises a back support pillow system for positioning a user's back in a comfortable position, a C-shaped neck pillow adapted to wrap around a user's neck, a cylindrical knee pillow adapted to be placed under a user's knees, or a combination thereof.

In some embodiments, the back support pillow system comprises a base pillow having a head end, a leg end, a middle region between the head end and the leg end, a first arm end, a second arm end, a top surface, and a bottom surface; a head indentation disposed in the top surface of the base pillow in between the head end and the middle region, the head indentation is positioned about halfway between the first arm end and the second arm end, the head indentation has an bottommost point, the bottommost point is at least ½ inch below the top surface of the base pillow, the head indentation is adapted to accept a portion of a user's head, wherein except for the head indentation the base pillow has uniform thickness; a pair of opposing wings, a first wing extends from the first arm end of the base pillow and the second wing extends from the second arm end of the base pillow, the wings provide the base pillow a broader width at its middle region as compared to its head end and leg end, the wings are adapted to support a user's arms; a lumbar support bar removably attachable to a first half attachment means disposed on the top surface of the base pillow in between the leg end and the middle region, the lumbar support bar is half-cylindrical in shape with a flat end and a curved end, a second half attachment means is disposed on the flat end, the second half attachment means engages the first half attachment means on the base pillow, when the lumbar support bar is attached to the base pillow the curved end extends upwardly from the top surface of the base pillow, the lumbar support bar is adapted to support a user's lumbar vertebrae.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 5 shows plane A, which separates the lower ends (132) of the wings (130) and the lumbar support bar (140), e.g., the lumbar support bar (140) is positioned at a location adjacent to plane A and the lower ends (132) of the wings (130) are positioned at a location adjacent to plane A opposite the lumbar support bar (140).

DESCRIPTION OF PREFERRED EMBODIMENTS

Referring now to FIG. 1-7, the present invention features a back support and positioning pillow system (100). The system (100) of the present invention can help provide support to the user's upper and lower back (e.g., cervical and lumbar spine areas), which may provide comfort to those areas. The system (100) may help a user sleep better.

Figure 1:
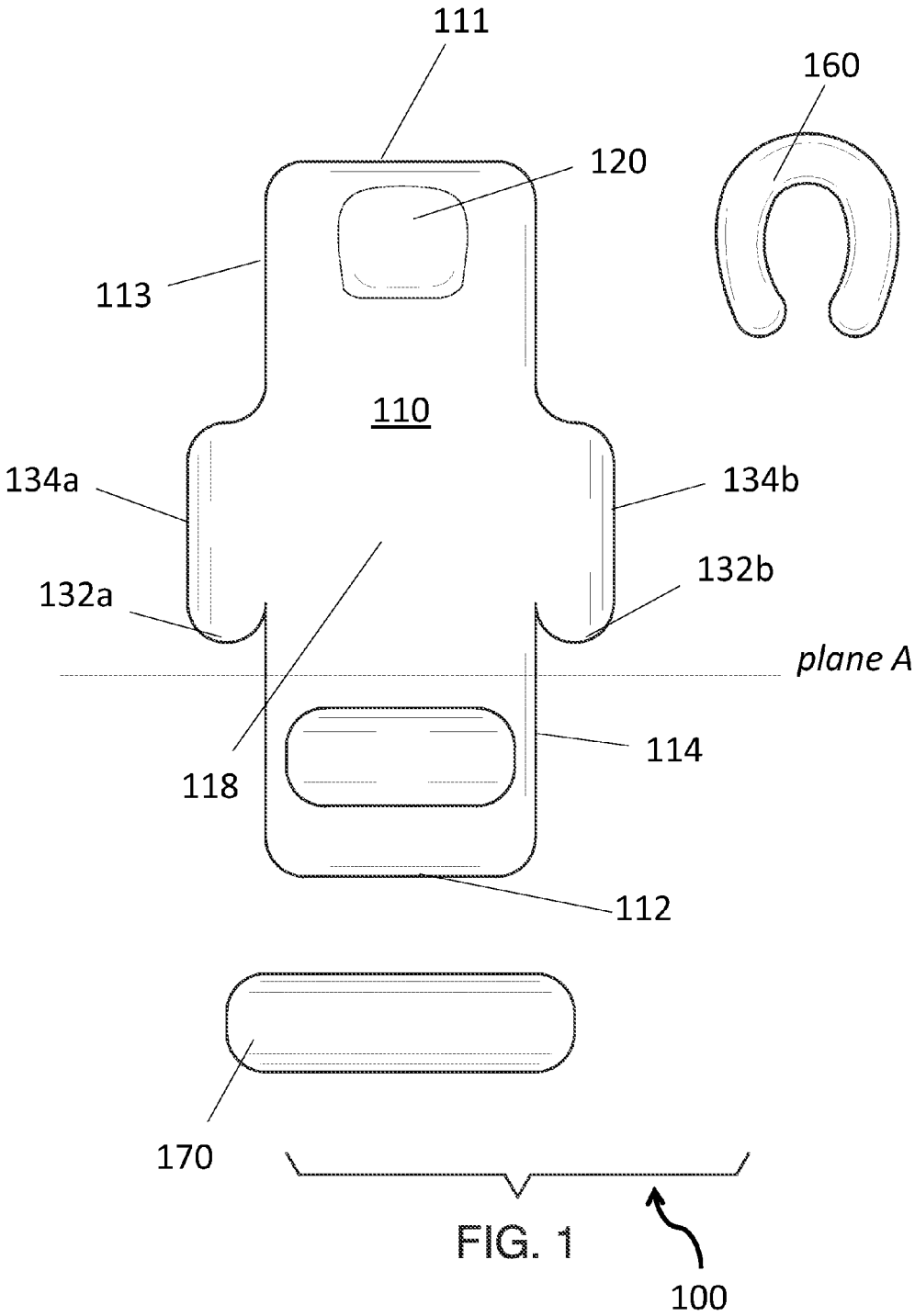
FIG. 1 is a top view of the system of the present invention. Shown in FIG. 1 is the first wing (130*a*) with a lower end (132*a*) and an outer edge (134*a*) and the second wing (130*b*) with a lower end (132*b*) and an outer edge (134*b*).
Figure 2:
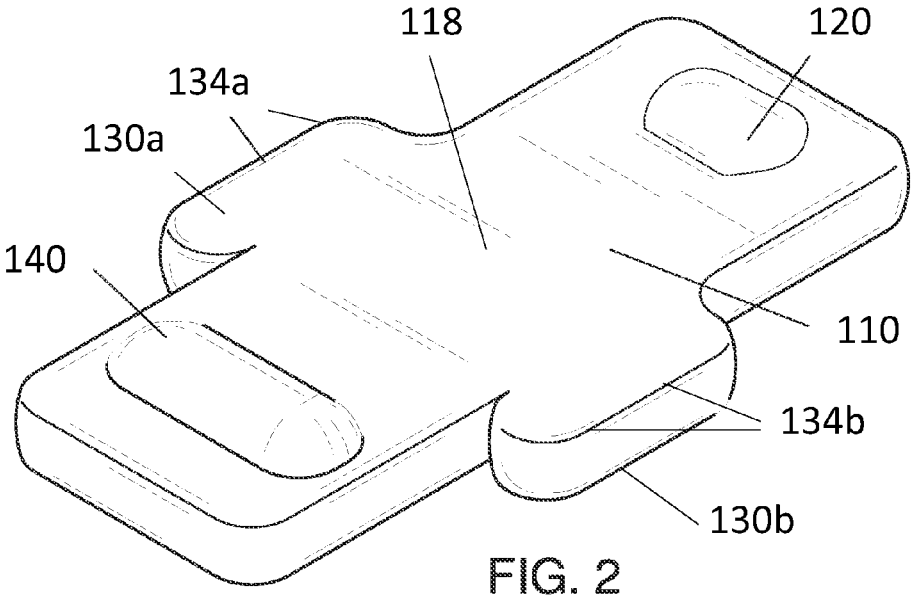
FIG. 2 is a perspective view of the system of the present invention. The base pillow (110) has an even surface extending from the outer edge (134*a*) of the first wing (130*a*) to the outer edge (134*b*) of the second wing (130*b*).
Figure 3:
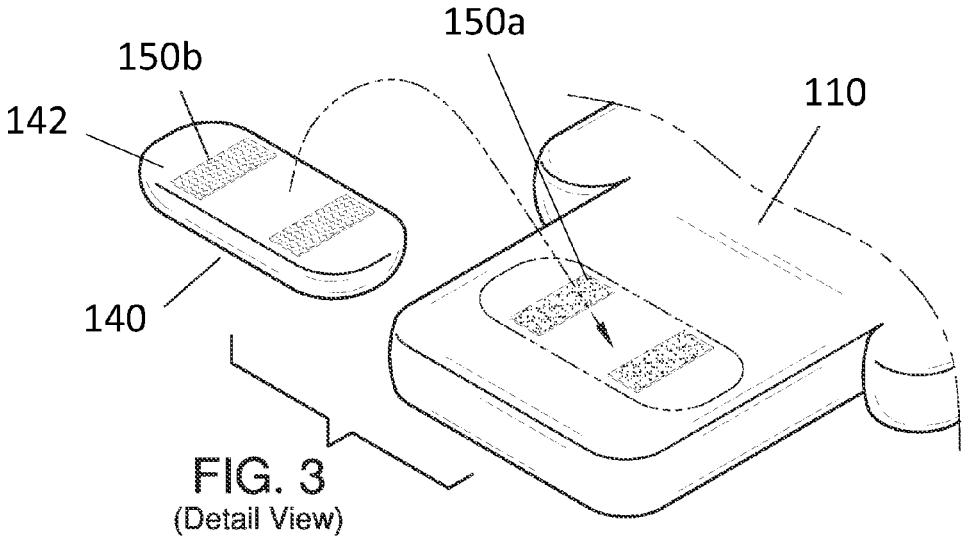
FIG. 3 is a detailed view of the system of the present invention.
Figure 4:
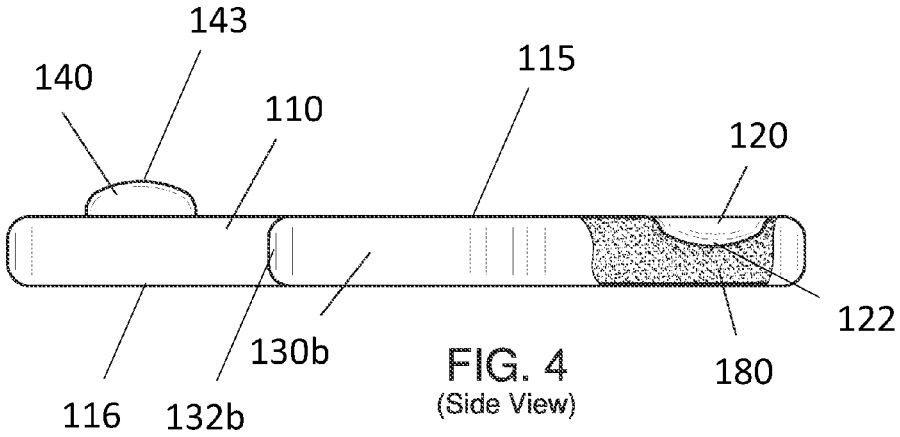
FIG. 4 is a side view of the system of the present invention.

As shown in FIG. 1 and FIG. 2, the system (100) comprises a base pillow (110). The base pillow (110) has a head end (111), a leg end (112) opposite the head end (111), a middle region (118) between the head end (111) and the leg end (112), a first arm end (113), a second arm end (114), a top surface (115), and a bottom surface (116).

A head indentation (120) is disposed in the top surface (115) of the base pillow (110) near the head end (110), e.g., in between the head end (111) and the middle region (118) of the base pillow (110). The head indentation (120) is adapted to support a user's head. For example, a portion of the user's head can rest inside the head indentation (120) (see FIG. 5). The head indentation (120) may be positioned about halfway between the first arm end (113) and the second arm end (114) of the base pillow (110). The head indentation (120) has an bottommost point (122), wherein the bottommost point (122) is at least ½ inch below the top surface (115) of the base pillow (110). The base pillow (110), except for the head indentation (120), has a uniform thickness (see FIG. 4).

In some embodiments, the bottommost point (122) of the head indentation is at least 1 inch below the top surface (115) of the base pillow (110). In some embodiments, the bottommost point (122) of the head indentation is at least 2 inches below the top surface (115) of the base pillow (110). In some embodiments, the bottommost point (122) of the head indentation is at least 3 inches below the top surface (115) of the base pillow (110).

A pair of opposing wings (130*a*, 130*b*) extends from the arm ends (113, 114) of the base pillow (110). For example, a first wing (130*a*) extends from the first arm end (113) of the base pillow (110), and a second wing (130*b*) extends from the second arm end (114) of the base pillow (110). The wings provide the base pillow (110) a broader width at its middle region (118) as compared to its head end (111) and leg end (112) (see FIG. 1). The wings (130*a*, 130*b*) are adapted to support a user's arms.

A first half attachment means (150*a*) is disposed on the top surface (115) of the base pillow (110) in between the leg end (112) and the middle region (118). A lumbar support bar (140) is removably attachable to the first half attachment means (150*a*). The lumbar support bar (140) is half-cylindrical in shape with a flat end (142) and a curved end (143). A second half attachment means (150*b*) is disposed on the flat end (142). The second half attachment means (150*b*) engages the first half attachment means (150*a*) on the base pillow (110) to secure (e.g., temporarily) the lumbar support bar (140). When the lumbar support bar (140) is attached to the base pillow (110), the curved end (143) extends upwardly from the top surface (115) of the base pillow (110) (see FIG. 4). The lumbar support bar (140) is adapted to support a user's lumbar vertebrae.

The attachments means (150) may include a hook-and-loop fastener mechanism, a snap mechanism, a magnet mechanism, an adhesive mechanism, the like, or a combination thereof.

In some embodiments, a C-shaped neck pillow (160) adapted to wrap around a user's neck is included with the system (100) of the present invention, e.g., in a kit. In some embodiments, a cylindrical knee pillow (170) adapted to be placed under a user's knees is included with the system (100) of the present invention, e.g., in a kit.

Figure 5:
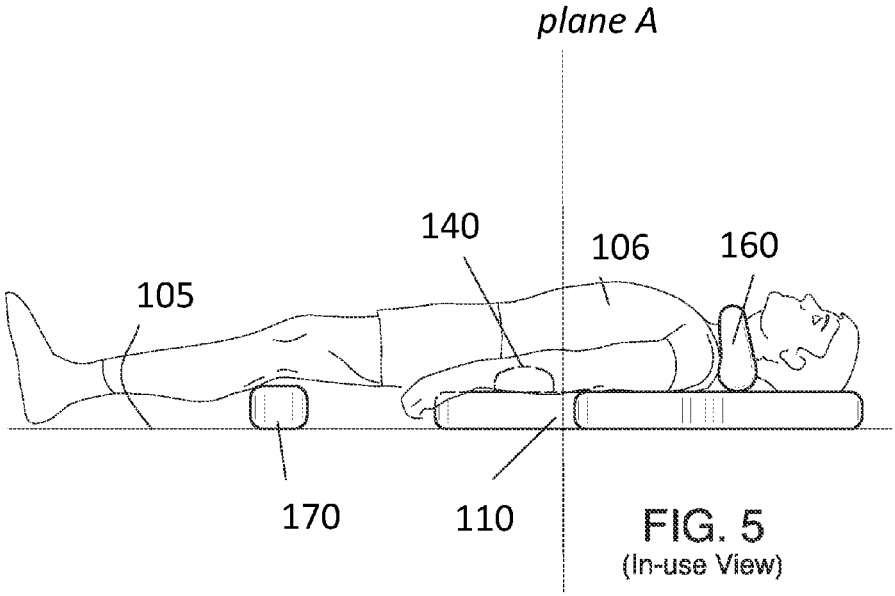
FIG. 5 is an in-use view of the system of the present invention.
Figure 6:
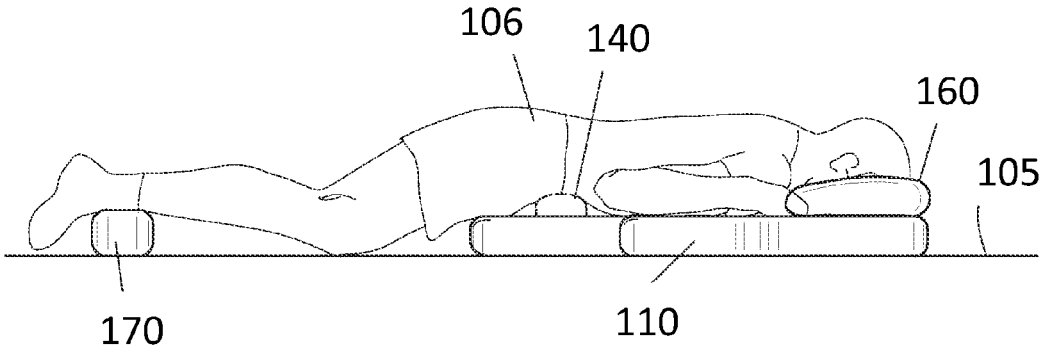
FIG. 6 is an in-use view of the system of the present invention.
Figure 7:
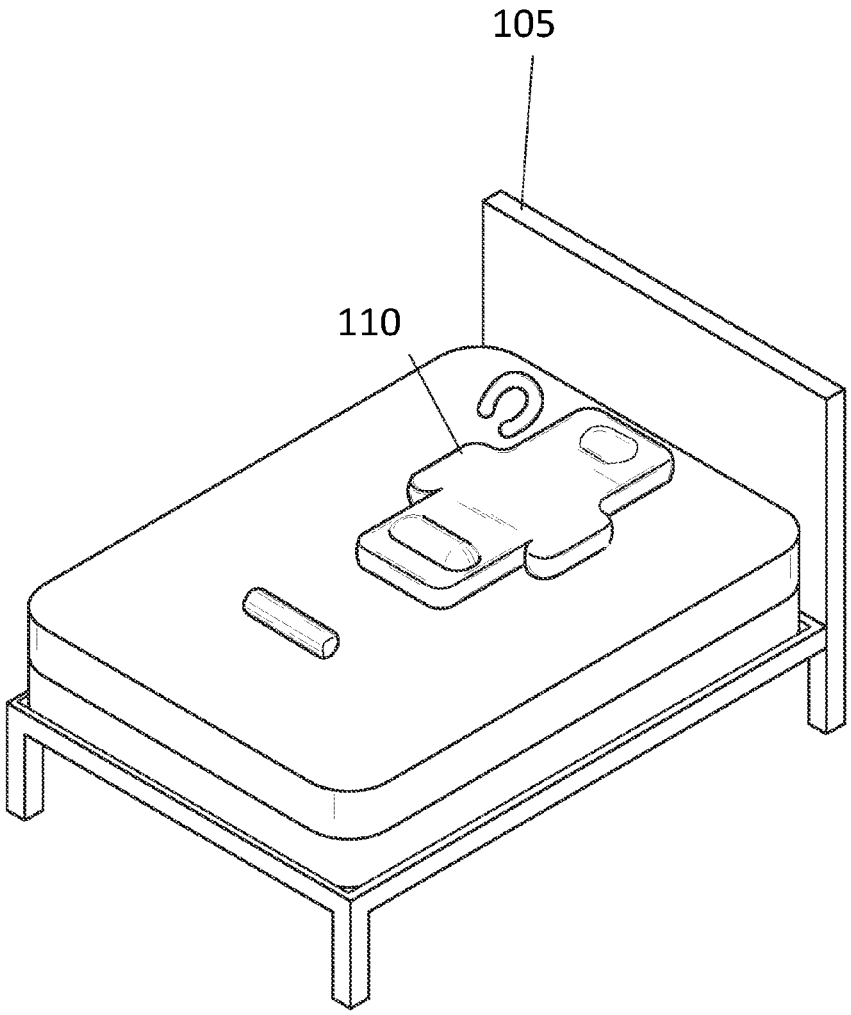
FIG. 7 is a perspective view of the system of the present invention.

The system (100) of the present invention can be used multiple ways. For example, as shown in FIG. 5 and FIG. 6, the system (100) can be placed on a bed (105). In some embodiments, as shown in FIG. 5, a user (105) can be lying on his/her back with the back of his/her head in the head indentation (120) and his/her lumbar vertebrae being supported by the lumbar support bar. In some embodiments, as shown in FIG. 6, a user (105) can be lying on his/her stomach with his/her face in the head indentation (120) and his/her stomach being supported by the lumbar support bar. The present invention is not limited the aforementioned uses.

In some embodiments, one or more components of the system (100), e.g., the base pillow (110), are constructed from a material comprising foam (180), for example memory foam. Memory foam is well known to one of ordinary skill in the art. In some embodiments, one or more components of the system (100) are covered with a hypoallergenic cover. In some embodiments, one or more components of the system (100) are covered with a satin cover.

As used herein, the term "about" refers to plus or minus 10% of the referenced number.

The disclosures of the following U.S. Patents are incorporated in their entirety by reference herein: U.S. Pat. No. 4,901,384; U.S. Pat. No. 4,987,625; U.S. Pat. No. 5,016,303; U.S. Pat. No. 5,048,137; U.S. Design Pat. No. D356,919; U.S. Pat. No. 5,423,098; U.S. Design Pat. No. D396,757; U.S. Pat. No. 5,987,675; U.S. Pat. No. 6,823,545; U.S. Pat. No. 7,661,163.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A pillow kit for providing comfort to user, said pillow kit system consisting of:

(a) a back support pillow system (100) for positioning a user's back in a comfortable position, said back support pillow system (100) comprising:

(i) a base pillow (110) having a head end (111), a leg end (112), a middle region (118) between the head end (111) and the leg end (112), a first arm end (113), a second arm end (114), a top surface (115), and a bottom surface (116);

(ii) a head indentation (120) disposed in the top surface (115) of the base pillow (110) in between the head end (111) and the middle region (118), the head indentation (120) is positioned about halfway between the first arm end (113) and the second arm end (114), the head indentation (120) has an bottommost point (122), the bottommost point (122) is at least ½ inch below the top surface (115) of the base pillow (110), the head indentation (120) is adapted to accept a portion of a user's head, wherein except for the head indentation (120) the base pillow has uniform thickness;

(iii) a pair of opposing wings (130*a*, 130*b*), a first wing (130*a*) extends from the first arm end (113) of the base pillow (110) and a second wing (130*b*) extends from the second arm end (114) of the base pillow (110), the wings provide the base pillow (110) a broader width at its middle region (118) as compared to its head end (111) and leg end (112), the wings (130*a*, 130*b*) are adapted to support a user's arms, the first wing (130*a*) has an outer edge (134*a*) and a lower end (132*a*) and the second wing (130*b*) has an outer edge (134*b*) and a lower end (132*b*), the base pillow (110) has an even surface extending from the outer edge (134*a*) of the first wing (130*a*) to the outer edge (134*b*) of the second wing (130*b*);

(iv) a lumbar support bar (140) removably attachable to a first half attachment means (150*a*) disposed on the top surface (115) of the base pillow (110) in between the leg end (112) and the middle region (118), the lumbar support bar (140) is half-cylindrical in shape with a flat end (142) and a curved end (143), a second half attachment means (150*b*) is disposed on the flat end (142), the second half attachment means (150*b*) engages the first half attachment means (150*a*) on the base pillow (110), when the lumbar support bar (140) is attached to the base pillow (110) the curved end (143) extends upwardly from the top surface (115) of the base pillow (110), the lumbar support bar (140) is adapted to support a user's lumbar vertebrae, wherein a plane A which separates the lower ends (132) of the wings (130) from the lumbar support bar (140) wherein the lumbar support bar (140) is positioned at a location adjacent to plane A and the lower ends (132) of the wings (130) are positioned at a location adjacent to plane A opposite the lumbar support bar (140);

(b) a C-shaped neck pillow (160) adapted to wrap around a user's neck; and (c) a cylindrical knee pillow (170) adapted to be placed under a user's knees.

2. The system (100) of claim 1, wherein the bottommost point (122) is at least 3 inches below the top surface (115) of the base pillow (110).

3. The system (100) of claim 1, wherein the bottommost point (122) is at least 1 inch below the top surface (115) of the base pillow (110).

4. The system (100) of claim 1, wherein the bottommost point (122) is at least 2 inches below the top surface (115) of the base pillow (110).

5. The system (100) of claim 4, wherein the first half attachment means (150*a*) and the second half attachment means (150*b*) are hook-and-loop fasteners.

6. The system (100) of claim 1, wherein the base pillow (110) is constructed from a material comprising foam (180).

* * * * *